US006344770B1

(12) United States Patent
Zha et al.

(10) Patent No.: US 6,344,770 B1
(45) Date of Patent: Feb. 5, 2002

(54) BANDGAP REFERENCE CIRCUIT WITH A PRE-REGULATOR

(75) Inventors: Gang Zha; Solomon K. Ng, both of Shenzhen (CN)

(73) Assignee: Shenzhen STS Microelectronics Co. LTD, Shenzhen (CN)

( * ) Notice: Subject to any disclaimer, the term of this patent is extended or adjusted under 35 U.S.C. 154(b) by 0 days.

(21) Appl. No.: 09/643,171

(22) Filed: Aug. 21, 2000

(30) Foreign Application Priority Data

Sep. 2, 1999 (CH) ..... 99118480 A

(51) Int. Cl.[7] ..... G05F 1/575; G05F 1/563

(52) U.S. Cl. ..... 327/539; 327/540; 323/266; 323/313

(58) Field of Search ..... 327/538, 539, 327/540; 323/266, 313, 314

(56) References Cited

U.S. PATENT DOCUMENTS

| | | | | | |
|---|---|---|---|---|---|
| 4,525,663 | A | * | 6/1985 | Henry | 323/280 |
| 4,990,846 | A | * | 2/1991 | Buck et al. | 323/314 |
| 5,631,551 | A | * | 5/1997 | Scaccianoce et al. | 323/281 |
| 5,686,823 | A | * | 11/1997 | Rapp | 323/313 |
| 5,952,873 | A | * | 9/1999 | Rincon-Mora | 327/539 |
| 6,121,824 | A | * | 9/2000 | Opris | 327/539 |

* cited by examiner

*Primary Examiner*—Timothy P. Callahan
*Assistant Examiner*—Terry L. Englund
(74) *Attorney, Agent, or Firm*—Lisa K. Jorgenson; Willaim J. Kubida

(57) ABSTRACT

A bandgap reference circuit has a pre-regulator that achieves a low temperature coefficient through the use of a $V_{BE}$ multiplier and feedback from the output bandgap voltage $V_{BG}$. This low temperature coefficient in the pre-regulator allows the bandgap reference circuit to output the bandgap voltage $V_{BG}$ with a low temperature coefficient.

20 Claims, 2 Drawing Sheets

BANDGAP REFERENCE CIRCUIT WITH A PRE-REGULATOR

TECHNICAL FIELD OF THE INVENTION

This invention relates in general to bandgap reference circuits and, more specifically, to devices and methods for providing bandgap reference circuits with low temperature coefficients.

BACKGROUND OF THE INVENTION

As shown in FIG. 1, a conventional bandgap reference circuit 10 includes a pre-regulator 12 that generates a regulated voltage $V_{REG}$ off the supply voltage $V_{CC}$ using a pair of current-mirror transistors Q1 and Q2, a resistor R1, and a set of series-connected diodes D1, D2, and D3. In addition, a start-up circuit 14—consisting of a bias transistor Q3, another set of series-connected diodes D4 and D5, and a resistor R2—biases a pair of $V_{BE}$-differential transistors Q4 and Q5 at start-up, after which the transistor Q3 shuts off, thereby effectively isolating the start-up circuit 14 from the rest of the bandgap reference circuit 10.

Together, a current source transistor Q9 and a $V_{BE}$-differential circuit 16 generate a differential voltage $V_{DIF}$ having a positive temperature coefficient from the regulated voltage $V_{REG}$ using a pair of current-mirror transistors Q6 and Q7, the $V_{BE}$-differential transistors Q4 and Q5, a pair of resistors R3 and R4, and a driver transistor Q8. As a result, the bandgap voltage $V_{BG}$ output from the bandgap reference circuit 10 across a resistor R5 equals the differential voltage $V_{DIF}$ plus the base-emitter voltage $V_{BE}$ of the transistor Q5. Because the base-emitter voltage $V_{BE}$ has a negative temperature coefficient, any variations in the base-emitter voltage $V_{BE}$ due to temperature are countered by variations in the differential voltage $V_{DIF}$, so that the bandgap voltage $V_{BG}$ should be relatively temperature independent. Unfortunately, the negative temperature dependence of the diodes D1, D2, and D3 makes the regulated voltage $V_{REG}$ relatively temperature dependent, which, in turn, makes the bandgap voltage $V_{BG}$ relatively temperature dependent.

Accordingly, there is a need in the art for an improved bandgap reference circuit that has a low temperature coefficient.

SUMMARY OF THE INVENTION

In accordance with this invention, a pre-regulator for generating a regulated voltage for use in generating a bandgap voltage from a bandgap reference circuit includes a current source (e.g., a wilson current source) and a $V_{BE}$ multiplier that receives current therefrom and generates/clamps the regulated voltage. Also, feedback circuitry regulates the current flow from the current source in response to feedback from the bandgap voltage.

In other embodiments of this invention, the pre-regulator described above is incorporated into a bandgap reference circuit.

In still another embodiment of this invention, a reference voltage is generated by driving a current into a $V_{BE}$ multiplier to generate and clamp a regulated voltage. The current is regulated in response to feedback from the reference voltage. Also, a $V_{BE}$ differential voltage is generated from the regulated voltage using a $V_{BE}$ differential circuit, and the reference voltage is generated from the $V_{BE}$ differential voltage and a base-emitter voltage drop.

DETAILED DESCRIPTION OF THE ILLUSTRATED EMBODIMENTS

Figure 2:
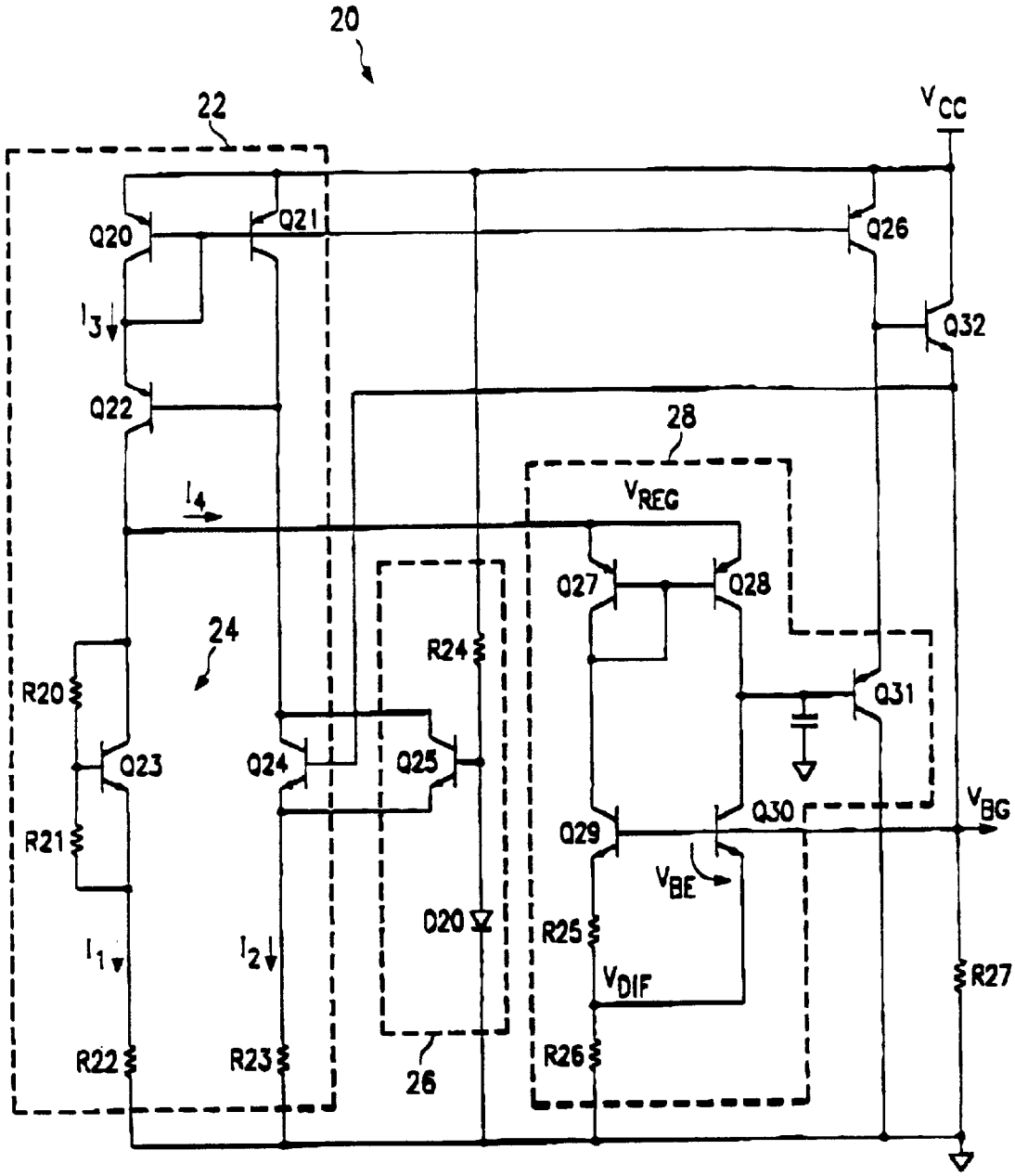
FIG. 2 is a circuit schematic illustrating a bandgap reference circuit in accordance with this invention.

As shown in FIG. 2, a bandgap reference circuit 20 in accordance with this invention includes a pre-regulator 22 that generates a regulated voltage $V_{REG}$ off the supply voltage $V_{CC}$ using a set of Wilson current source transistors Q20, Q21, and Q22, a $V_{BE}$-multiplier 24 (consisting of a pair of resistors R20 and R21 and a transistor Q23), a feedback transistor Q24, and a pair of bias resistors R22 and R23. In addition, a start-up circuit 26—consisting of a bias transistor Q25, a diode D20, and a resistor R24—draws current from the Wilson current source transistors Q20, Q21, and Q22 at start-up. Once the bandgap voltage $V_{BG}$ is established, the transistor Q25 shuts off.

Together, a current source transistor Q26 and a $V_{BE}$-differential circuit 28 generate a differential voltage $V_{DIF}$ having a positive temperature coefficient from the regulated voltage $V_{REG}$ using a pair of current-mirror transistors Q27 and Q28, a pair of $V_{BE}$-differential transistors Q29 and Q30, a pair of resistors R25 and R26, and a driver transistor Q31. As a result, the bandgap voltage $V_{BG}$ output from the bandgap reference circuit 20 across a resistor R27 equals the differential voltage $V_{DIF}$ plus the base-emitter voltage $V_{BE}$ of the transistor Q30. Because the base-emitter voltage $V_{BE}$ has a negative temperature coefficient, any variations in the base-emitter voltage $V_{BE}$ due to temperature are countered by variations in the differential voltage $V_{DIF}$, so that the bandgap voltage $V_{BG}$ is relatively temperature independent. An output transistor Q32 provides current to the bandgap voltage $V_{BG}$.

Figure 1:
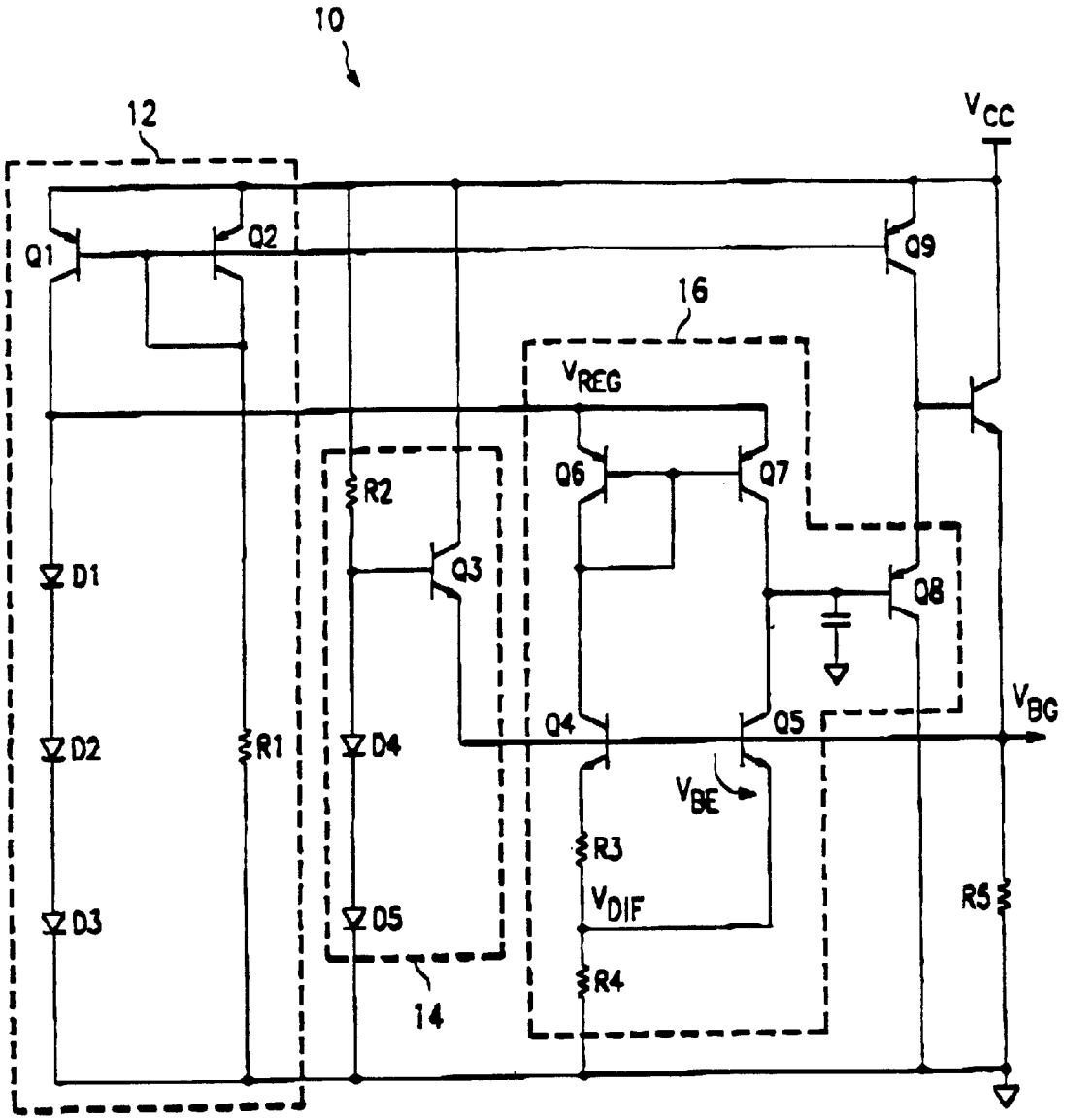
FIG. 1 (PRIOR ART)
FIG. 1 is a circuit schematic illustrating a conventional bandgap reference circuit.

The improved pre-regulator 22 gives the bandgap reference circuit 20 a lower temperature coefficient than the conventional bandgap reference circuit 10 (see FIG. 1) previously described by providing a regulated voltage $V_{REG}$ with a lower temperature coefficient. Specifically, the temperature coefficient $T_C$ of the regulated voltage $V_{REG}$ can be calculated as follows.

The currents $I_1$, $I_2$, $I_3$, and $I_4$ can be determined as follows:

$$I_2=(V_{BG}-V_{BE})/R23 \tag{1}$$

$$I_3=N(V_{BG}-V_{BE})/R23 \tag{2}$$

where N is the size of the transistor Q20 relative to the transistor Q21, $$I_4 = 2(V_{BEQ30} - V_{BEQ29})/R25 \tag{3}$$

$$= 2V_T\ln(A)/R25 \tag{4}$$

where A is the size of the transistor Q29 relative to the transistor Q30, $$I_1 = I_3 - I_4 \tag{5}$$

$$= (N(V_{BG} - V_{BE})/R23) - (2V_T\ln(A)/R25) \tag{6}$$

In addition, the regulated voltage $V_{REG}$ can be calculated as follows:

$$V_{REG} = (1+m)V_{BE} + I_1R22 \tag{7}$$

-continued $$= (1+m)V_{BE} + (N(R22/R23))(V_{BG} - V_{BE}) - 2V_T\ln(A)(R22/R25) \quad (8)$$

$$= NV_{BG}(R22/R23) + (1+m-N(R22/R23))V_{BE} - 2V_T\ln(A)(R22/R25) \quad (9)$$

where m is the value of the resistor R20 relative to the resistor R21.

Further, the temperature coefficient $T_C$ can be calculated as follows:

$$T_C = dV_{REG}/dT \quad (10)$$

$$= (1+m-N(R22/R23))(dV_{BE}/dT) - 2\ln(A)(R22/R25)(dV_T/dT) \quad (11)$$

Setting $T_C$=0, and assuming $dV_{BE}/dT$=−2 mV/° C. and $dV_T/dT$=0.086 mV/° C., we find the following:

$$(1+m-N(R22/R23))/(2In(A)(R22/R25))=(dV_T/dT)/(dV_{BE}/dT)=-0.086/2 \quad (12)$$

We can then calculate appropriate values for m, N, R22, R23, A, and R25 from equations (9) and (12) above so as to achieve the desired regulated voltage $V_{REG}$ and a zero (or close to zero) temperature coefficient $T_C$. For example, a regulated voltage $V_{REG}$ of 1.66V and a temperature coefficient $T_C$ of 0.09 mV/° C. can be achieved with N=2, A=6, m=0.4, R22, R23=8 KOhms, and R25=2.4 KOhms.

This invention thus provides a low temperature coefficient bandgap reference circuit. Also, the use of a Wilson current source in the pre-regulator helps the reference circuit achieve a Power Supply Rejection Ratio (PSRR) exceeding 80 dB. Further, the circuit is able to operate using low supply voltages (e.g., $V_{CC}$=2.7 Volts).

Of course, it should be understood that although this invention has been described with reference to bipolar transistors, it is equally applicable to other transistor technologies, including MOSFET technologies.

Although this invention has been described with reference to particular embodiments, the invention is not limited to these described embodiments.

Rather, the invention is limited only by the appended claims, which include within their scope all equivalent devices and methods that operate according to the principles of the invention as described.

What is claimed is:

1. A bandgap reference circuit for generating a bandgap voltage, the bandgap reference circuit comprising:

a pre-regulator for generating a regulated voltage, the pre-regulator including:

a wilson current source;

a $V_{BE}$ multiplier coupled to the wilson current source for receiving current therefrom and clamping the regulated voltage; and a feedback transistor coupled to the wilson current source for regulating the current flow therefrom in response to feedback from the bandgap voltage;

a $V_{BE}$ differential circuit coupled to the pre-regulator for generating a $V_{BE}$ differential voltage from the regulated voltage; and an output transistor coupled to the $V_{BE}$ differential circuit for generating the bandgap voltage from the $V_{BE}$ differential voltage and a base-emitter voltage drop.

2. The bandgap reference circuit of claim 1, further comprising a start-up circuit coupled to the pre-regulator for drawing current from the wilson current source at start-up.

3. The bandgap reference circuit of claim 2, wherein the start-up circuit includes a bipolar transistor biased by a resistor connected in series with a diode.

4. The bandgap reference circuit of claim 1, wherein the wilson current source includes a plurality of bipolar transistors.

5. The bandgap reference circuit of claim 1, wherein the feedback transistor comprises a bipolar transistor.

6. The bandgap reference circuit of claim 1, wherein the $V_{BE}$ differential circuit includes a pair of current mirror bipolar transistors.

7. The bandgap reference circuit of claim 1, wherein the output transistor comprises a bipolar transistor that generates the bandgap voltage at its emitter.

8. A circuit for generating a reference voltage, the circuit comprising:

a pre-regulator for generating a regulated voltage, the pre-regulator including:

a current source;

a $V_{BE}$ multiplier coupled to the current source for receiving current therefrom and clamping the regulated voltage; and feedback circuitry coupled to the current source for regulating the current flow therefrom in response to feedback from the reference voltage;

a $V_{BE}$ differential circuit coupled to the pre-regulator for generating a $V_{BE}$ differential voltage from the regulated voltage; and output circuitry coupled to the $V_{BE}$ differential circuit for generating the reference voltage from the $V_{BE}$ differential voltage and a base-emitter voltage drop.

9. The circuit of claim 8, wherein the current source comprises a wilson current source.

10. The circuit of claim 8, wherein the feedback circuitry comprises a feedback bipolar transistor.

11. The circuit of claim 8, wherein the output circuitry comprises an output bipolar transistor.

12. The circuit of claim 8, further comprising a start-up circuit coupled to the pre-regulator for drawing current from the current source at start-up.

13. The circuit of claim 12, wherein the start-up circuit includes a bipolar transistor biased by a resistor connected in series with a diode.

14. A method for generating a reference voltage, the method comprising:

driving a current into a $V_{BE}$ multiplier to generate and clamp a regulated voltage;

regulating the current directly in response to feedback from the reference voltage;

generating a $V_{BE}$ differential voltage from the regulated voltage using a $V_{BE}$ differential circuit; and generating the reference voltage from the $V_{BE}$ differential voltage and a base-emitter voltage drop.

15. The method of claim 14, wherein the act of driving a current into a $V_{BE}$ multiplier includes driving the current with a wilson current source.

16. The method of claim 14, wherein the act of regulating the current includes regulating the current using a feedback bipolar transistor.

17. The method of claim 14, wherein the act of generating the $V_{BE}$ differential voltage includes generating said voltage using a $V_{BE}$ differential circuit having a pair of current mirror bipolar transistors.

18. The method of claim 14, wherein the act of generating the reference voltage includes generating said voltage by applying the $V_{BE}$ differential voltage at the base of an output bipolar transistor and taking the reference voltage at the emitter of said transistor.

19. A pre-regulator for generating a regulated voltage for use in generating a bandgap voltage from a bandgap reference circuit, the pre-regulator comprising:

a current source;

a $V_{BE}$ multiplier coupled to the current source for receiving current therefrom and clamping the regulated voltage; and feedback circuitry coupled to the current source for regulating the current flow therefrom directly in response to feedback from the bandgap voltage.

20. The pre-regulator of claim 19, wherein the current source comprises a wilson current source.

* * * * *